US010615476B2

(12) United States Patent
Kingston et al.

(10) Patent No.: US 10,615,476 B2
(45) Date of Patent: Apr. 7, 2020

(54) METHOD OF MANUFACTURING A MICROSTRIP CIRCULATOR

(71) Applicant: Trak Microwave Corporation, Tampa, FL (US)

(72) Inventors: James P. Kingston, Tampa, FL (US); Jose Gil, Lutz, FL (US); David E. Barry, Dunedin, FL (US)

(73) Assignee: SMITHS INTERCONNECT, INC., Tampa, FL (US)

( * ) Notice: Subject to any disclaimer, the term of this patent is extended or adjusted under 35 U.S.C. 154(b) by 0 days.

(21) Appl. No.: 16/244,971

(22) Filed: Jan. 10, 2019

(65) Prior Publication Data

US 2019/0148806 A1 May 16, 2019

Related U.S. Application Data

(63) Continuation of application No. 15/593,067, filed on May 11, 2017, now Pat. No. 10,333,192.

(60) Provisional application No. 62/482,559, filed on Apr. 6, 2017, provisional application No. 62/436,980, filed on Dec. 20, 2016, provisional application No. 62/339,700, filed on May 20, 2016.

(51) Int. Cl.

| | |
|---|---|
| ***H01F 7/06*** | (2006.01) |
| ***H01P 1/387*** | (2006.01) |
| ***H01P 11/00*** | (2006.01) |

(52) U.S. Cl.

CPC ..... *H01P 1/387* (2013.01); *H01P 11/001* (2013.01)

(58) Field of Classification Search

CPC ..... H01P 11/001; H01P 1/387

See application file for complete search history.

(56) References Cited

U.S. PATENT DOCUMENTS

| | | | | |
|---|---|---|---|---|
| 3,621,476 | A * | 11/1971 | Kanbayashi | H01P 1/387 333/1.1 |
| 3,787,958 | A * | 1/1974 | Freedman | B23K 20/233 228/175 |
| 5,384,556 | A * | 1/1995 | Coles | H01P 1/387 333/1.1 |
| 7,609,124 | B2 * | 10/2009 | Mukai | H01P 1/387 333/1.1 |
| 8,134,422 | B2 * | 3/2012 | Yamamoto | H01P 1/387 333/1.1 |

(Continued)

FOREIGN PATENT DOCUMENTS

| | | |
|---|---|---|
| JP | S57 123713 | 8/1982 |
| JP | 06-310914 A | 11/1994 |

(Continued)

*Primary Examiner* — Paul D Kim

(74) *Attorney, Agent, or Firm* — Snell & Wilmer LLP

(57) ABSTRACT

A microstrip circulator includes a carrier and a ferrite slab having a first side and a second side. The circulator further includes a first microwave epoxy positioned between the carrier and the first side of the ferrite slab. The circulator further includes a conductor having a center portion with three legs extending therefrom. The circulator further includes a second microwave epoxy positioned between the second side of the ferrite slab and the conductor. The circulator further includes an insulator and a third microwave epoxy positioned between the conductor and the insulator. The circulator further includes a magnet and a fourth epoxy positioned between the insulator and the magnet.

11 Claims, 5 Drawing Sheets

(56) References Cited

U.S. PATENT DOCUMENTS

| | | | | |
|---|---|---|---|---|
| 2003/0107448 | A1 | 6/2003 | Kocharyan | |
| 2003/0112089 | A1 | 6/2003 | Jun et al. | |
| 2004/0174224 | A1 | 9/2004 | Kington et al. | |
| 2004/0174225 | A1 | 9/2004 | Kingston et al. | |
| 2006/0017520 | A1* | 1/2006 | Kingston | H01P 1/387 333/1.1 |
| 2011/0193649 | A1* | 8/2011 | Popelka | H01P 1/387 333/1.1 |
| 2017/0104256 | A1* | 4/2017 | Bedinger | H01F 7/02 |

FOREIGN PATENT DOCUMENTS

| | | |
|---|---|---|
| JP | 2007 049758 | 2/2007 |
| KR | 10-1007544 | 1/2011 |

* cited by examiner

METHOD OF MANUFACTURING A MICROSTRIP CIRCULATOR

CROSS-REFERENCE TO RELATED APPLICATIONS

This application is a continuation of, and claims the benefit and priority of, U.S. patent application Ser. No. 15/593,067, titled "Below Resonance Circulator and Method of Manufacturing the Same" and filed on May 11, 2017, now U.S. Pat. No. 10,333,192, which claims the benefit and priority of U.S. Provisional Patent Application No. 62/482,559, filed on Apr. 6, 2017, titled "Below Resonance Circulator and Method of Manufacturing the Same," claims the benefit and priority of U.S. Provisional Patent Application No. 62/436,980, filed on Dec. 20, 2016, titled "Below Resonance Circulator and Method of Manufacturing the Same" and claims the benefit and priority of U.S. Provisional Patent Application No. 62/339,700, filed on May 20, 2016, titled "Below Resonance Circulator and Method of Manufacturing the Same," the entire contents of all applications being hereby incorporated by reference herein.

BACKGROUND

1. Field

The present disclosure generally relates to surface mount below resonance circulators and methods of manufacturing surface mount below resonance circulators.

2. Description of the Related Art

Below resonance circulators and isolators are devices that are designed for applications from three Gigahertz (3 GHz) to over 30 GHz. Such circulators and isolators may be used in radio and radar frequency applications such as radar scanners, high-definition radio transmitters, or the like.

Three different types of circulators are currently available in the market. The first type of circulator includes a packaged circulator junction device with a center conductor having a lead that is bent down to be flush with a mounting surface. These types of circulators may be referred to as surface mount circulators. Such circulators have disadvantages such as having relatively fragile leads which limits how the circulators can be packaged and shipped.

The second type of circulator includes a packaged circulator junction device designed to be mounted on a printed circuit board (PCB). The PCB may include one or more via hole or edge wrap in order to transfer the RF signal to the surface of the PCB where it can be received by the circulator. The circulators also have disadvantages. For example, such circulators may experience increased signal loss due to the added interface between the PCB and the circulator because of difficulty matching the signal with use of the via holes.

Furthermore, each of these first two types of circulators includes housings in order to maintain compression on the components. This housing may be relatively expensive to manufacture because it should be machined with relatively small tolerances in order to maintain the compression on the components.

The third type of circulator includes a microstrip circulator with an edge wrap. These circulators include a carrier to aid in focusing a magnetic field. Use of the edge wrap in such circulators requires removal of the carrier. Removal of the carrier undesirably reduces performance of the device.

Thus, there is a need in the art for below resonance circulators that are relatively inexpensive to manufacture and that provide relatively high performance.

SUMMARY

Disclosed herein is a microstrip circulator. The circulator includes a carrier and a ferrite slab having a first side and a second side. The circulator further includes a first microwave epoxy positioned between the carrier and the first side of the ferrite slab. The circulator further includes a conductor having a center portion with three legs extending therefrom. The circulator further includes a second microwave epoxy positioned between the second side of the ferrite slab and the conductor. The circulator further includes an insulator and a third microwave epoxy positioned between the conductor and the insulator. The circulator further includes a magnet and a fourth epoxy positioned between the insulator and the magnet.

Also disclosed is a circulator that is compatible with tape and reel packaging. The circulator includes a carrier having at least three ground members extending therefrom. The circulator further includes a ferrite slab having a first side facing the carrier and a second side. The circulator further includes an insulator. The circulator further includes a conductor positioned between the insulator and the second side of the ferrite slab and having a center portion and three legs extending therefrom, each of the three legs positioned adjacent to one of the at least three ground members. The circulator further includes a magnet positioned on another side of the insulator relative to the conductor such that the insulator is positioned between the magnet and the conductor.

Also disclosed is a method of manufacturing a microstrip circulator. The method includes forming a pre-circulator structure by stacking, in order, a carrier, a first microwave epoxy, a ferrite slab, a second microwave epoxy, a conductor having a center portion with three legs extending therefrom, a third microwave epoxy, and an insulator. The method further includes applying pressure to the pre-circulator structure and heating the pre-circulator structure with the pressure applied to a first temperature in order to cure the first microwave epoxy, the second microwave epoxy, and the third microwave epoxy. The method further includes stacking a fourth epoxy on the insulator and a magnet on the fourth epoxy. The method further includes heating the combination of the pre-circulator structure, the fourth epoxy, and the magnet to a second temperature in order to cure the fourth epoxy.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Described herein are below resonance circulators (which may also be referred to as isolators) and methods for manufacturing such circulators. The circulators are formed with an independent center conductor and without an external compressive force, such as a housing. The circulators further include a single ferrite element without any film metallization thereon. Various components of the circulators may be coupled together using a low loss nonconductive microwave epoxy, such as a low loss nonconductive sheet adhesive.

The circulators described herein have various advantages over conventional circulators. Use of a single non-metallized ferrite element and use of the independent center conductor reduces a total quantity of components relative to conventional circulators. Furthermore, use of the microwave epoxy reduces or eliminates a need for a housing. The reduced quantity of components and the lack of a housing may reduce manufacturing costs of the circulator. The particular designs disclosed herein result in a relatively high performance circulator that is compatible with tape and real packaging.

Figure 1:
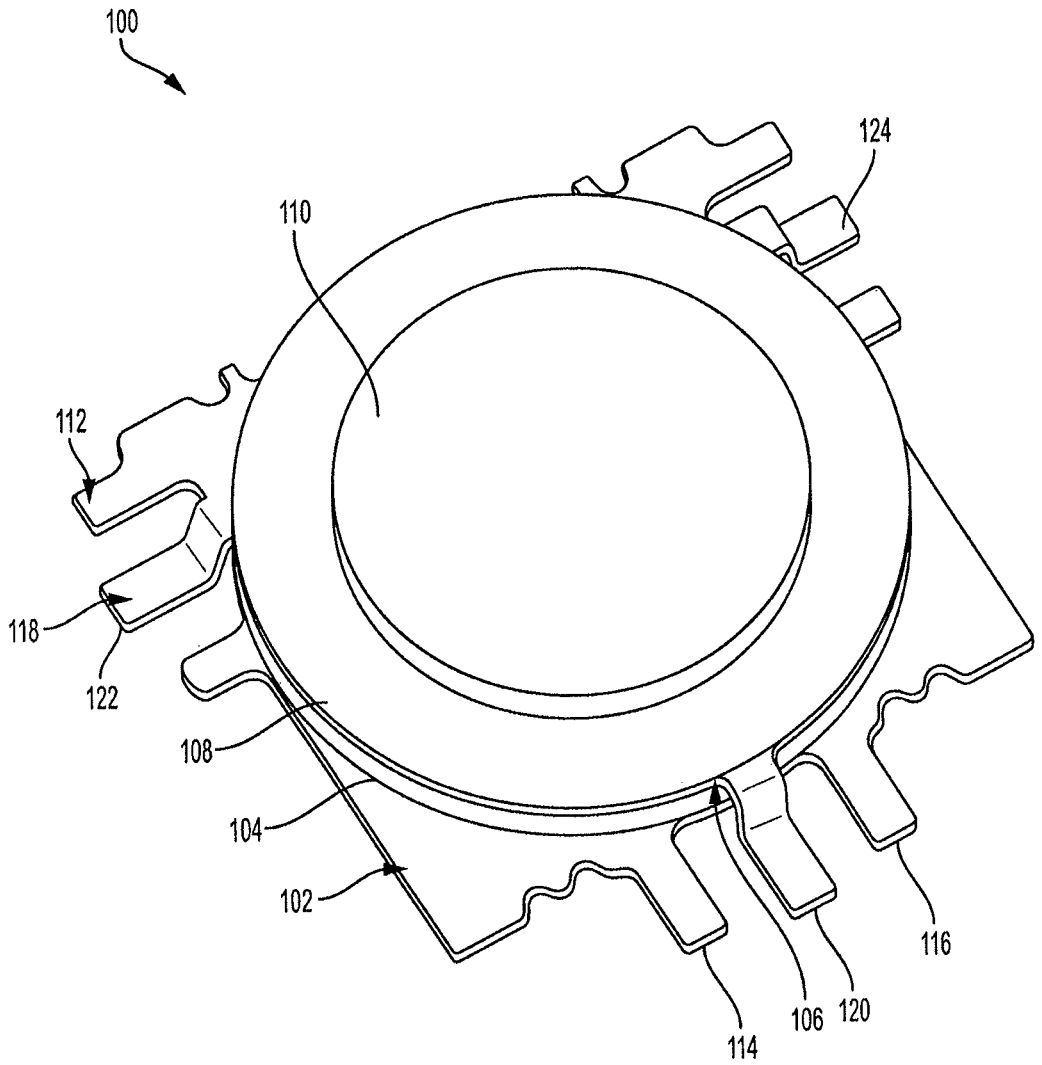
FIG. 1 is a picture showing a top view of a below resonance circulator that is packaged in such a way as to be compatible with tape and reel packaging and having microwave epoxy as a bonding agent between various components of the circulator according to an embodiment of the present disclosure.

Referring to FIG. 1, an exemplary circulator 100 is shown. The circulator 100 may include a carrier 102, a ferrite slab 104, a conductor 106, an insulator 108, and a magnet 110. The carrier 102 may be conductive and may function as a ground plane. The carrier 102 includes a plurality of ground members 112 extending outward from the carrier 102. The ground members 112 may function to connect the carrier 102 to a ground of a circuit such as on a circuit board.

The ferrite slab 104 may be biased by the magnet 110 to create a chamber within the ferrite slab 104. As will be described below, this chamber is where operations on the signals occur. Unlike ferrite elements used in conventional microstrip circulators, the ferrite slab 104 may be non-metallized meaning it may have no plating positioned thereon.

The conductor 106 is designed to receive and output signals of the circulator. In that regard, the conductor 106 includes three legs 118 that each correspond to a signal path of the circulator. Each of the three legs may be spaced apart by approximately 120 degrees. In some embodiments, each of the three legs may be spaced apart by any distance between 95 degrees and 145 degrees, or between 100 degrees and 140 degrees, or between 110 degrees and 130 degrees.

The insulator 108 may insulate the center conductor 106 from the magnet 110. In some embodiments, the insulator 108 may include a sleeve or a spacer.

As mentioned above, the magnet 110 may bias the ferrite slab 104 to create the chamber within the ferrite slab 104.

In operation, a signal may be received by a first leg 120. As the signal travels inward along the first leg 120, it may be received within the chamber of the ferrite slab 104 where it may resonate. Based on the direction of bias of the ferrite slab 104 (which is controlled by the polarity of the magnet 110), the signal may be output as a null signal on a second leg 122 or on a third leg 124, and may be output as a signal that closely resembles the input signal on the other of the second leg 122 or the third leg 124. In some embodiments, the circulator 100 may be designed to operate between 2 gigahertz (GHz) and 30 GHz, or between 3 GHz and 20 GHz.

Figure 2:
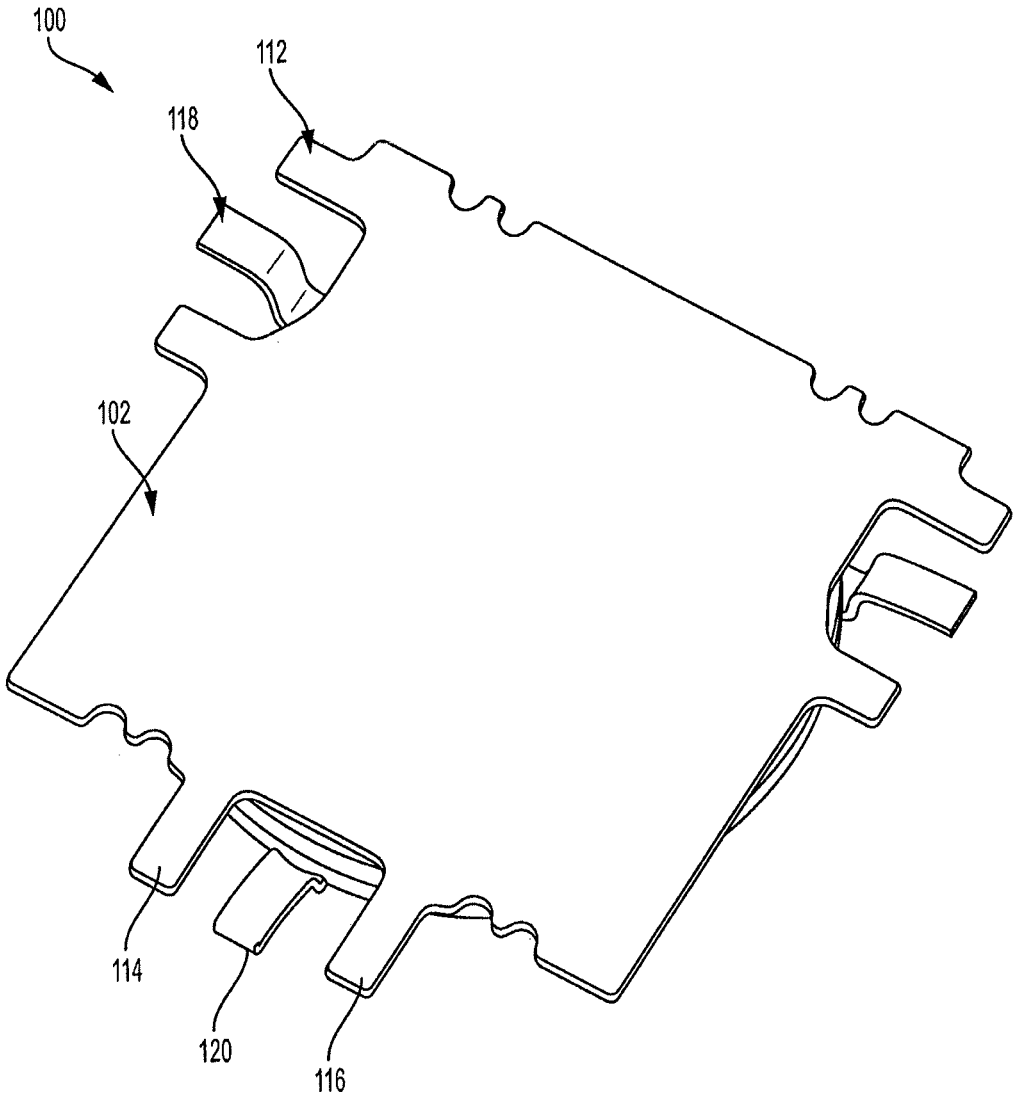
FIG. 2 is a picture showing a bottom view of the below resonance circulator of FIG. 1 according to an embodiment of the present disclosure.
Figure 3:
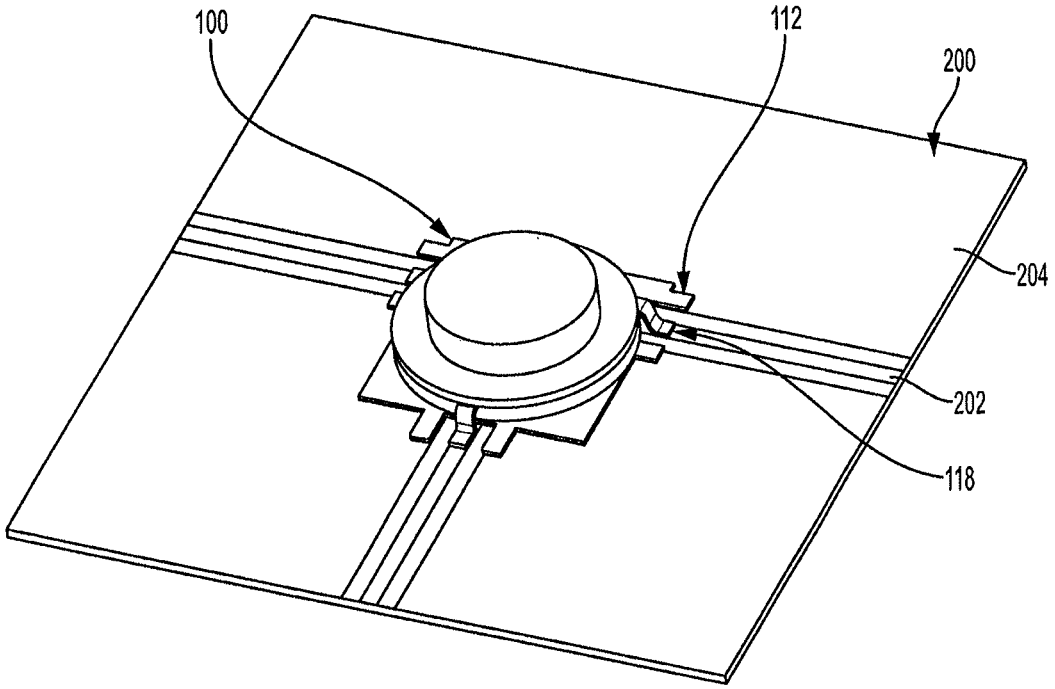
FIG. 3 is a drawing of the below resonance circulator of FIG. 1 mounted on a circuit board according to an embodiment of the present disclosure.

Referring to FIGS. 1, 2, and 3, each of the legs 118 of the conductor 106 may be bent such that a bottom surface of each of the legs 118 is relatively flush with a bottom surface of the carrier 102. In that regard, the circulator 100 may be mounted on a circuit board 200. The circulator 100 may be electrically and mechanically coupled to the circuit board 200 by applying solder to a joint between the circuit board 200 and the carrier 102, and by applying solder to a joint between the circuit board 200 and each of the legs 118. In that regard, each of the legs 118 may also be electrically connected to a corresponding signal trace 202, and the carrier 102 may be electrically connected to a ground trace 204.

Each of the legs 118 may be relatively prone to damage. The ground members 112 of the carrier 102 may be designed to reduce the likelihood of damage to each of the legs 118. As shown, the carrier 102 includes 6 ground members 112 and each of the legs 118 is positioned adjacent to and between two of the ground members 112. For example, the first leg 120 is positioned adjacent to and between a first ground member 114 and a second ground member 116. The ground members 112 may be sturdier than the legs 118. Stated differently, the ground members 112 may have a greater resistance to bending than the legs 118. In that regard, in response to contact with an external object, the ground members 112 may resist bending or breaking and may reduce contact between the legs 118 and an external object, thus protecting the legs 118. In some embodiments, the circulator 100 may include any quantity of ground members 112.

Figure 4:
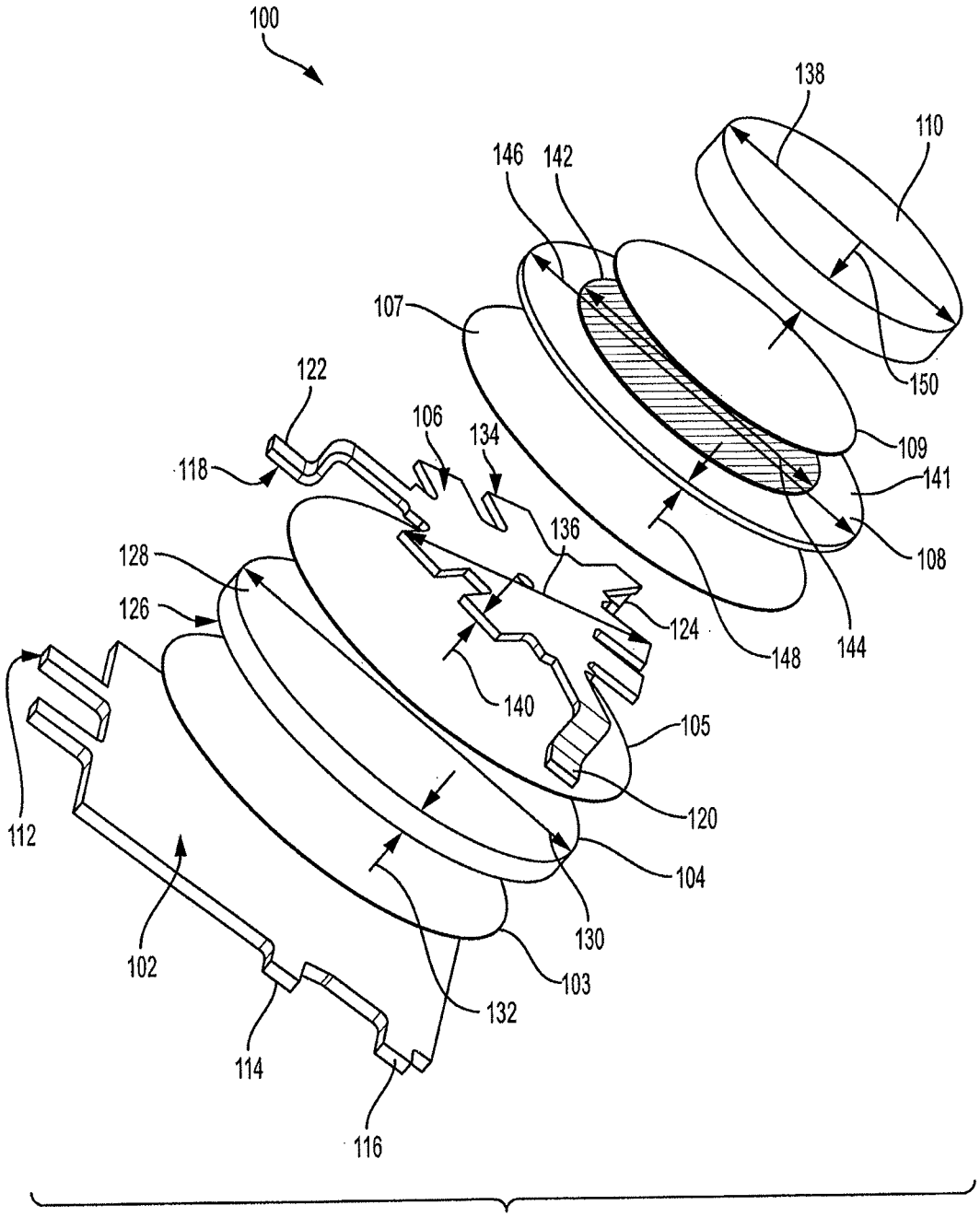
FIG. 4 is an exploded view of the below resonance circulator of FIG. 1 to illustrate various components of the below resonance circulator including a single ferrite disc, a single solid center, and other components bonded together using the microwave epoxy according to an embodiment of the present disclosure.

Turning to FIG. 4, an exploded view of the circulator 100 illustrates features of the various components. As shown, various epoxies may be used between adjacent components. In particular, a first epoxy 103 may be positioned between the carrier 102 and the ferrite slab 104. A second epoxy 105 may be positioned between the conductor 106 and the ferrite slab 104. A third epoxy 107 may be positioned between the conductor 106 and the insulator 108. A fourth epoxy 109 may be positioned between the insulator 108 and the magnet 110.

The epoxies 103, 105, 107, 109 may be used to bond the various components of the circulator 100 together. In that regard, use of the epoxies 103, 105, 107, 109 reduces or eliminates the need for a housing, thus reducing an overall weight and cost of the circulator 100.

Some or all of the epoxies 103, 105, 107, 109 may include low loss microwave epoxies. In particular, the first epoxy 103, the second epoxy 105, and the third epoxy 107 may include low loss microwave epoxies and the fourth epoxy 109 may include a structural epoxy. In some embodiments, the fourth epoxy 109 may also or instead include a microwave epoxy. In some embodiments, the microwave epoxy may be used as the second epoxy 105 located between the ferrite slab 104 and the conductor 106. In these embodiments, other epoxies may be used between the other components of the circulator 100. In some embodiments, each of the epoxies 103, 105, 107, 109 may include one or more of a microwave epoxy or a non-microwave epoxy.

It is desirable for the microwave epoxies 103, 105, 107 to have particular characteristics in order to improve performance of the circulator 100. In particular, it is desirable for the microwave epoxy to have one or more of the following characteristics:

(1) to have a relatively low loss tangent at microwave frequencies (such as having a dissipation factor less than 0.004, less than 0.003, or less than 0.0025 at 10 GHz) in order to keep insertion loss of the device low;

(2) to have nonconductive properties in order to allow the microwave epoxy to be utilized between each component of the circulator 100 without reducing performance of the circulator 100;

(3) to have a relatively high melting temperature (such as above 175 degrees Celsius, or above 200 degrees Celsius, or above 230 degrees Celsius) in order to allow the microwave epoxy to withstand curing and solder reflow temperatures;

(4) to have relatively high chemical resistance in order to allow the epoxy to withstand cleaning processes to which the circulator may be exposed (such as resistance to chemicals including acetone alcohol and degreasers); and (5) to be available in a thickness that is between 0.0001 inches and 0.005 inches, between 0.0005 inches and 0.003 inches, or between 0.001 inches and 0.002 inches in order to allow the epoxy to minimally impact microwave signals.

An exemplary microwave epoxy suitable for use in the circulator 100 may include ULTRALAM® 3908, available from Rogers Corporation of Rogers, Conn.

The carrier 102 may include a conductive metal. In some embodiments, the metal may include a magnetic material such as steel, stainless steel, Kovar, Silvar, or the like. In some embodiments, the carrier 102 may be metallized. In particular, the carrier 102 may include plating, such as silver plating or gold plating, in order to reduce insertion loss of signals.

The magnetic properties of the carrier 102 may function to attract magnetic fields generated by the magnet 110. By attracting such magnetic fields, the carrier 102 increases the likelihood that the magnetic fields travel in a direction perpendicular to a first side 126 and a second side 128 of the ferrite slab 104. Stated differently, the carrier 102 increases the likelihood that the magnetic fields travel straight through the ferrite slab 104 from the first side 126 to the second side 128. Causing the magnetic fields to travel perpendicular to the sides 126, 128 of the ferrite slab 104 increases the performance of the circulator 100.

It is desirable for a surface area of the carrier 102 to be at least as large as a surface area of the first side 126 of the ferrite slab 104. The shape of the carrier 102 may be square, rectangular, circular, or the like. The thickness of the carrier 102 may vary based on the application. However, it may be desirable for the thickness of the carrier 102 to be greater than a thickness of the conductor 106 such that the ground members 112 can protect the legs 118 from bending or breaking without experiencing damage themselves. For example, the thickness of the carrier may be between 0.001 inches and 0.1 inches (0.025 mm and 2.54 mm) or between 0.01 inches and 0.04 inches (0.25 mm and 1.0 mm).

Use of the ground members 112 to protect the legs 118 allows the circulator 100 to be compatible with tape and real packaging. This is because the ground members 112 reduce the likelihood of the legs 118 receiving sufficient impact during packaging and shipping to damage the legs 118.

The ferrite slab 104 may have any shape, such as square, rectangular, circular, or the like. In some embodiments and as shown, the ferrite slab 104 may have a circular shape. The circular shape may be desirable as it is cheaper to produce a circular ferrite slab than a ferrite slab having a different shape. Thus, the circular shape may result in a reduced cost of the circulator 100.

The ferrite slab 104 may have a diameter 130. In some embodiments, the diameter 130 may be between 0.067 inches and 1 inch (1.7 millimeters (mm) and 25.4 mm), between 0.125 inches and 0.75 inches (3.18 mm and 19.1 mm), or between 0.125 inches and 0.5 inches (3.18 mm and 12.7 mm).

The ferrite slab 104 may have a thickness 132. In some embodiments, the thickness 132 may be between 0.005 inches and 0.050 inches (0.13 mm and 1.3 mm), between 0.005 inches and 0.040 inches (0.13 mm and 1.0 mm), or between 0.010 inches and 0.040 inches (0.25 mm and 1.0 mm).

Unlike conventional circulators, the ferrite slab 104 of the circulator 100 may function without being metallized. The step of applying a metal plating to a ferrite slab may be relatively expensive. In that regard, forming the ferrite slab 104 of the circulator 100 without metallization results in significant cost savings when manufacturing the circulator 100.

The conductor 106 may include a conductive metal. In some embodiments, the metal of the conductor 106 may be nonmagnetic. For example, the conductor 106 may include brass, copper, beryllium copper, gold, silver, or the like. In some embodiments, the conductor 106 may be metallized. In that regard, the conductor 106 may be plated such as with silver or gold. Such metallization of the conductor 106 may reduce insertion loss, thus increasing performance of the circulator 100.

As described above, the conductor 106 may include three legs 118 extending therefrom. The conductor 106 may further include resonators 134 positioned between each of the legs 118. The conductor 106 may include between one and four resonators positioned between each of the legs 118. As shown in in FIG. 4, the conductor 106 includes two resonators 134 positioned between each of the legs 118.

The resonators 134 may dictate the operating frequency of the circulator 100. The resonators 134 may further aid in impedance matching of the circulator 100 by adding capacitance. In some embodiments, the resonators 134 may provide impedance matching for frequencies within 10%, or 20%, or 30% of a desired bandwidth. In order to achieve the desired effect, it is desirable for a diameter 136 of the resonators 134 to be equal or less than a diameter 138 of the magnet 110.

The conductor 106 may have a thickness 140. In some embodiments, the thickness 140 may be between 0.002 inches and 0.015 inches (0.051 mm and 0.38 mm) or between 0.003 inches and 0.012 inches (0.076 mm and 0.30 mm).

Use of the microwave epoxy as the second epoxy 105 between the ferrite slab 104 and the conductor 106 provides advantages. For example, use of the microwave epoxy eliminates the need to include any thin or thick film deposition on the ferrite slab 104, thus reducing the manufacturing cost of the circulator 100.

The insulator 108 may include any insulating material. For example, the insulator 108 may include a plastic, ceramic, rubber, or the like. It is undesirable for the magnet 110 to contact the conductor 106. In that regard, the insulator 108 insulates the magnet 110 from the conductor. In some embodiments, the insulator 108 may include a spacer as shown in FIG. 4. In some embodiments, the insulator 108 may include another shape, such as a sleeve positioned around the magnet 110 or around a portion of the conductor 106.

The insulator 108 may include a surface 141 having a metal 142 positioned on a portion of the surface 141. The metal 142 may operate as a ground plane. In some embodiments, the metal 142 may include copper or brass etched on to the insulator 108. Through experimentation, it was determined that use of the metal 142 on the portion of the surface 141 alleviates current induced on the magnet 110. Accordingly, inclusion of the metal 142 reduces losses experienced by the circulator 100.

The metal 142 may have a diameter 144. In some embodiments, it is desirable for the diameter 144 of the metal 142 to be about the same as the diameter 138 of the magnet 110. Where used in this context, about the same means that the diameter 144 of the metal 142 is within 20%, or 10%, or 5% of the diameter 138 of the magnet.

The insulator 108 may have a diameter 146. The diameter 146 of the insulator 108 may be about the same as the diameter 130 of the ferrite slab 104.

The insulator 108 may have a thickness 148. The thickness 148 may be between 0.001 inches and 0.050 inches (0.025 mm and 1.3 mm), between 0.005 inches and 0.040 inches 0.13 mm and 1.0 mm), or between 0.005 inches and 0.020 inches (0.13 mm and 0.51 mm).

The magnet 110 may include any magnetic material. For example, the magnet 110 may include samarium cobalt, ceramic barium ferrite, alnico, neodymium, or the like. The magnet 110 may include any shape such as a square, rectangle, triangle, circle, or the like. It may be desirable to use a circular magnet as it is less expensive to form a circular magnet than any other shape. Accordingly, use of a circular magnet may result in reduced manufacturing costs.

It may be desirable for the diameter 138 of the magnet 110 to be less than the diameter 130 of the ferrite slab 104. For example, the diameter 138 of the magnet 110 may be between 0.067 inches and 0.75 inches (1.7 mm and 19.1 mm) or between 0.125 inches and 0.5 inches (3.18 mm and 12.7 mm). A diameter of the electrical chamber within the ferrite slab 104 may be about the same as the diameter 138 of the magnet 110.

The magnet 110 may also have a thickness 150. The thickness 150 of the magnet 110 may be, for example, between 0.010 inches and 0.100 inches (0.25 mm and 2.54 mm), between 0.010 inches and 0.080 inches (0.25 mm and 2.0 mm), or between 0.020 inches and 0.075 inches (0.51 mm and 1.9 mm).

Figure 5:
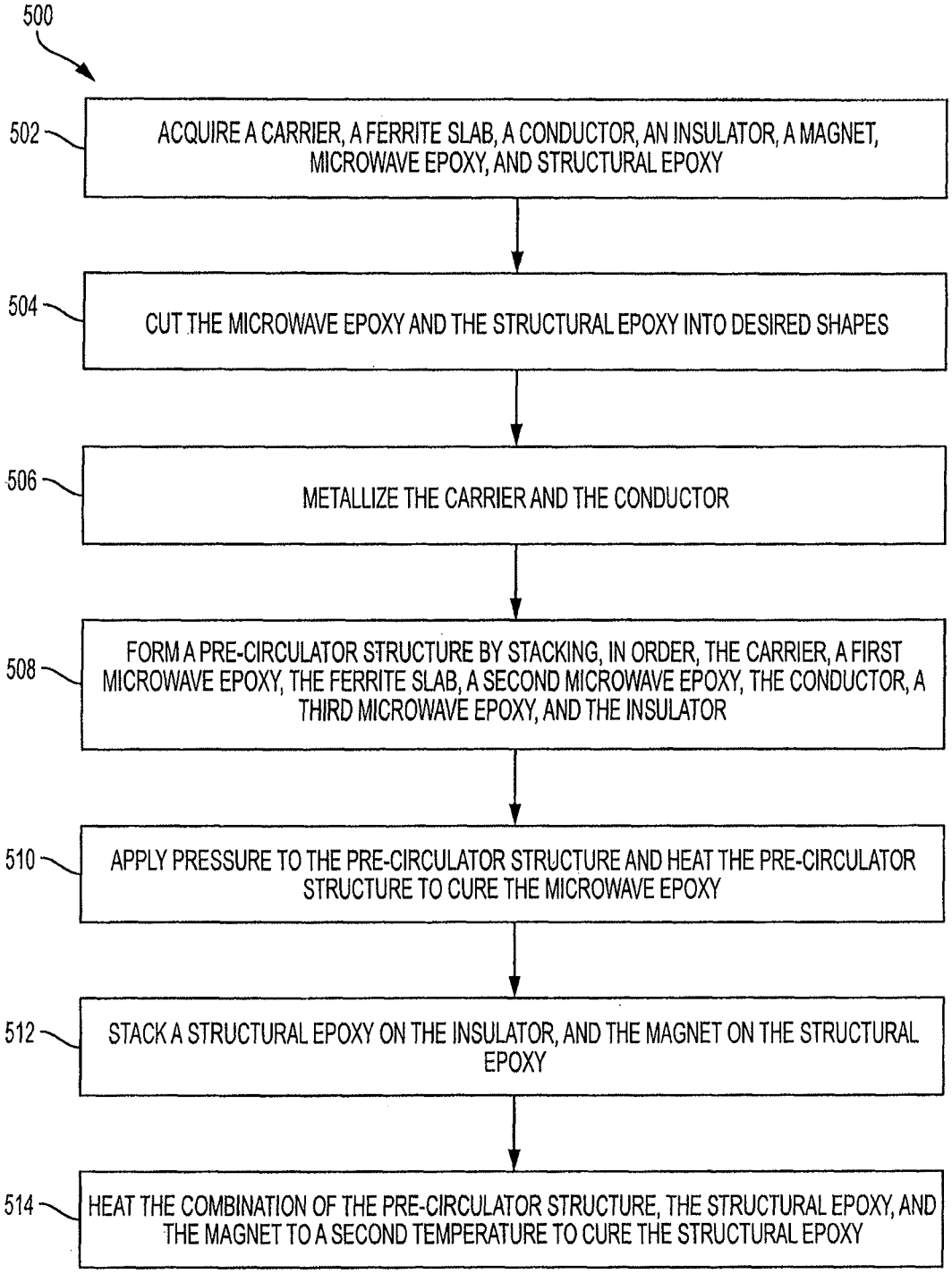
FIG. 5 is a flowchart illustrating a method for forming a below resonance circulator using microwave epoxy according to an embodiment of the present disclosure.

Turning to FIG. 5, a method 500 for forming a circulator, such as the circulator 100 of FIG. 1, is shown. In block 502, the method 500 includes acquiring a carrier, a ferrite slab, a conductor, an insulator, a magnet, microwave epoxy, and structural epoxy. The carrier, ferrite slab, conductor, insulator, and magnet may be formed or purchased in their final shape. For example, these components may be formed by stamping, forging, or other processes known in the art. The microwave epoxy and the structural epoxy may be purchased in sheet form or in fluid form or may be manufactured using processes known in the art.

In block 502, the microwave epoxy and the structural epoxy may be cut into their desired shapes. For example and with brief reference to FIG. 4, each of the first epoxy 103, the second epoxy 105, and the third epoxy 107 may be cut to have the desired shape from the sheet of microwave epoxy. Likewise, the first epoxy 103, the second epoxy 105, and the third epoxy 107 may have substantially similar diameters (i.e., within 20%, or within 10%, or within 5% of each other). The diameters of these epoxies 103, 105, and 107 may be about the same as the diameter 130 of the ferrite slab 104. The fourth epoxy 109 may be cut to have the desired shape from the sheet of structural epoxy and may have a diameter that is about the same as the diameter 138 of the magnet 110.

Returning to FIG. 5, the carrier and the conductor may be metallized in block 506. For example, the carrier and the conductor may be plated with gold, silver, tin, or the like.

In block 508, some of the components may be stacked on top of each other to form a pre-circulator structure. For example, the carrier may be positioned on a surface. A first microwave epoxy may be positioned on the carrier and the ferrite slab may be positioned on the first microwave epoxy. A second microwave epoxy may be positioned on the ferrite slab and the conductor may be placed on the second microwave epoxy. A third microwave epoxy may be positioned on the conductor and the insulator may be positioned on the third microwave epoxy. The structural epoxy and the magnet may not be placed with the other components at this point.

In block 510, the pre-circulator structure may be cured in order to bond the components together. It is desirable for pressure to be applied to the components during the bonding process to ensure effective coupling between the components. In that regard, pressure may be applied to the pre-circulator structure at the same time heat is applied to bond the pre-circulator structure. The pressure may be applied, for example, using a clamp having ends that sandwich components from the carrier to the insulator.

For example, the applied pressure may be between 5 pounds per square inch (psi) and 40 psi (34 Kilopascals (kPa) and 276 kPa), between 10 psi and 30 psi (69 kPa and 207 kPa), or between 15 psi and 25 psi (103 kPa and 172 kPa). The applied temperature may be between 180 degrees Celsius (C) and 350 degrees C. (356 degrees Fahrenheit (F) and 662 degrees F.), between 200 degrees C. and 325 degrees C. (392 degrees F. and 617 degrees F.), or between 250 degrees C. and 300 degrees C. (482 degrees F. and 572 degrees F.).

The pressure may be applied during the entire heating phase. For example, the pre-circulator structure may be exposed to the high temperatures for 30 minutes and may remain exposed to the pressure for an additional 15 minutes after removal of the heat.

After the pre-circulator structure is cured, a structural epoxy may be stacked on the pre-circulator structure and the magnet may be stacked on the structural epoxy in block 512. For example, the structural epoxy may include Ablebond® 8700K, available from Henkel of Dusseldorf, Germany.

In block 514, the combination of the pre-circulator structure, the structural epoxy, and the magnet may be cured. For example, the combination may be exposed to relatively high temperatures in order to cause the structural epoxy to bond to the insulator and the magnet. For example, the combination may be exposed to temperatures between 150 degrees C. and 200 degrees C. (302 degrees F. and 392 degrees F.) or between 165 degrees C. and 185 degrees C. (329 degrees F. and 365 degrees F.).

After the structural epoxy has bonded to the magnet and the insulator, formation of the circulator may be complete.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A method of manufacturing a microstrip circulator comprising:

forming a pre-circulator structure by stacking, in order, a carrier, a first microwave epoxy, a ferrite slab, a second microwave epoxy, a conductor having a center portion with three legs extending therefrom, a third microwave epoxy, and an insulator;

applying pressure to the pre-circulator structure and heating the pre-circulator structure with the pressure applied to a first temperature in order to cure the first microwave epoxy, the second microwave epoxy, and the third microwave epoxy;

stacking a fourth epoxy on the insulator and a magnet on the fourth epoxy; and heating the combination of the pre-circulator structure, the fourth epoxy, and the magnet to a second temperature in order to cure the fourth epoxy.

2. The method of claim 1 wherein:

the pressure is between 15 pounds per square inch (psi) and 25 psi, and the first temperature is between 180 degrees Celsius and 350 degrees Celsius.

3. The method of claim 1 wherein the carrier includes six ground members, and forming the pre-circulator structure further includes a step of positioning each of the three legs of the conductor between a different pair of two of the six ground members.

4. The method of claim 1 wherein the insulator includes a non-conductive spacer having a surface with a metal layer positioned on at least a portion of the surface, and forming the pre-circulator structure includes orienting the surface with the metal layer away from the third microwave epoxy such that the surface with the metal layer faces the magnet in the completed microstrip circulator.

5. The method of claim 1 further comprising plating each of the carrier and the conductor with at least one of gold or silver.

6. The method of claim 1 further comprising forming the first microwave epoxy, the second microwave epoxy, and the third microwave epoxy by cutting each of the first microwave epoxy, the second microwave epoxy, and the third microwave epoxy in a desired shape from a sheet of microwave epoxy that has insulating properties, has a thickness between 0.0005 inches and 0.003 inches, and has a melting temperature of at least 175 degrees Celsius.

7. The method of claim 1 further comprising bending the three legs of the conductor to be at least partially flush with a plane of the carrier.

8. The method of claim 1 further comprising placing the completed microstrip circulator on a tape to be used in a tape and reel packaging.

9. A method of manufacturing a microstrip circulator comprising:

forming a pre-circulator structure by stacking, in order, a carrier, a first microwave epoxy, a ferrite slab, a second microwave epoxy, a conductor having a center portion with three legs extending therefrom, a third microwave epoxy, and an insulator;

bending the three legs of the conductor to be at least partially flush with a plane of the carrier;

applying pressure of between 15 pounds per square inch (psi) and 25 psi to the pre-circulator structure and heating the pre-circulator structure with the pressure applied to a first temperature of between 180 degrees Celsius and 350 degrees Celsius in order to cure the first microwave epoxy, the second microwave epoxy, and the third microwave epoxy;

stacking a fourth epoxy on the insulator and a magnet on the fourth epoxy; and heating the combination of the pre-circulator structure, the fourth epoxy, and the magnet to a second temperature in order to cure the fourth epoxy.

10. The method of claim 9 wherein the carrier includes six ground members, and forming the pre-circulator structure further includes a step of positioning each of the three legs of the conductor between a different pair of two of the six ground members.

11. The method of claim 9 wherein the insulator includes a non-conductive spacer having a surface with a metal layer positioned on at least a portion of the surface, and forming the pre-circulator structure includes orienting the surface with the metal layer away from the third microwave epoxy such that the surface with the metal layer faces the magnet in the completed microstrip circulator.

* * * * *